United States Patent [19]

Grohoski

[11] 4,241,442

[45] Dec. 23, 1980

[54] TIMEPIECE WITH SHAPED COMPONENTS

[75] Inventor: Raymond J. Grohoski, Watertown, Conn.

[73] Assignee: Timex Corporation, Waterbury, Conn.

[21] Appl. No.: 63,274

[22] Filed: Aug. 2, 1979

[51] Int. Cl.[3] ..... G04B 37/00

[52] U.S. Cl. ..... 368/294; 368/295; 368/296; 368/300; 368/314; 368/276

[58] Field of Search ..... 58/90 R, 91, 88 R, 88 G, 58/88 W, 53, 54, 55, 56; 368/294–296, 300, 314, 276

[56] References Cited

U.S. PATENT DOCUMENTS

| | | | |
|---|---|---|---|
| 3,748,849 | 7/1973 | Takagi | 58/91 X |
| 4,136,515 | 1/1979 | Thompson et al. | 58/90 R |

FOREIGN PATENT DOCUMENTS

| | | | |
|---|---|---|---|
| 2135177 | 3/1972 | Fed. Rep. of Germany | 58/90 R |
| 435123 | 9/1966 | Switzerland | 58/88 G |

*Primary Examiner*—Ulysses Weldon
*Attorney, Agent, or Firm*—Edward J. Timmer

[57] ABSTRACT

A novel construction is provided for a timepiece of the type having a shaped (or non-circular) case and crystal in conjunction with a circular caseback. The construction typically includes a shaped case having a shaped recess in one side and a circular aperture in the other side with a central cylindrical bore therebetween. The bottom of the shaped recess is formed by the intersection of the recess and cylindrical bore and is in the form of an annular shoulder having a non-circular outer periphery and a circular inner periphery providing a central opening in the recess bottom. Supported in the cylindrical bore and visible through the central opening in the bottom of the recess is a circular dial plate. A decorative annular mask having a shaped outer periphery corresponding to that of the recess and circular inner periphery of such size to provide a circular window for viewing the dial plate overlies the annular shoulder of the recess bottom to hide the annular shoulder from view and provide a decorative border around the circular dial plate when viewed through a transparent crystal shaped to fit in the non-circular recess. The decorative mask typically is positioned between the crystal and annular shoulder and may be an independent preformed annular member or a coating applied to the crystal or shoulder.

A circular caseback is usable with this novel construction to close off the aperture on the other side of the case. A water-resistant timepiece can be readily provided by placing a resilient O-ring between the circular caseback and case and sealant such as epoxy between the crystal and case.

11 Claims, 3 Drawing Figures

TIMEPIECE WITH SHAPED COMPONENTS

FIELD OF THE INVENTION

The invention involves a timepiece having certain shaped components and, in preferred form, to a timepiece of the type having a shaped case and crystal and a circular caseback.

DESCRIPTION OF THE PRIOR ART

In the past, there has been a problem in providing wrist-watches of the type just mentioned in acceptable sizes. The problem stems from the assembly sequence commonly utilized in the watch industry in which the watch movement with the dial mounted thereatop is inserted into the case through the rear case opening and from the fact that the dial is of corresponding shape to the case and crystal, i.e., non-circular. To insert the movement-dial plate subassembly through the rear case opening requires that the diameter of the circular opening be equal to or larger than the longest dial plate dimension and this, of course, means that in most cases the size of the case itself must be increased, oftentimes substantially. As a result, it has been considered impractical to have a rear case opening of circular shape and a corresponding circular caseback in wrist-watches having a shaped case and crystal. This situation is unfortunate when the wrist-watch must be water resistant since a circular rear case opening and caseback are more easily and effectively sealed against moisture than the same components of non-circular shape.

Wrist watches of the type having a shaped case and crystal with a circular caseback are illustrated in several patents. For example, the Guggi et al U.S. Pat. No. 2,989,838 issued June 27, 1961; Fischer U.S. Pat. No. 3,545,197 issued Dec. 8, 1970; and Monnet U.S. Pat. No. 4,059,957 issued Nov. 29, 1978, show wrist-watches having a non-circular case with a non-circular upper opening and circular rear opening therein. A non-circular crystal is fitted in the upper case opening along with a non-circular dial plate which is positioned below on the movement. A circular caseback is screwed or snap-fitted in the rear case opening. It appears that these watches are assembled by inserting the movement with the shaped dial plate fixed thereon through the upper case opening.

Wrist-watch constructions employing a shaped case with a circular crystal, dial plate and caseback are described in the Hirabayaski et al U.S. Pat. No. 3,744,238 issued June 10, 1973, and the Takagi U.S. Pat. No. 3,748,849 issued July 31, 1973. The Hirabayaski patent employs a crystal having a rectangular shape on its top central portion and an annular bottom flange which provides a circular outer periphery for engagement in the circular aperture in a rectangular case. A circular caseback is screwed into a circular threaded rear case opening. In the Takagi patent, the wrist-watch includes a rectangular case having a central cylindrical bore therethrough defining circular upper and lower case openings on opposite sides. The upper case opening is closed by a circular crystal while the lower opening is closed by a circular caseback. Force-fitted over the crystal and case is a rim member which has a rectangular outer peripheral shape to match the case and an oval inner profile. The rim member overlaps above a circular dial which is provided with an oval pattern of time indicia that lies along the inner profile or window of the rim member when viewed by the wearer. This wrist-watch thus gives the appearance of a shaped crystal and dial while using circular versions of these components.

The Miyashita U.S. Pat. No. 3,696,608 issued Oct. 10, 1972 and the Miyasaka U.S. Pat. No. 3,940,922 issued Mar. 2, 1976, also involve watches with shaped cases and selected other components, the latter however utilizing a non-circular caseback.

SUMMARY OF THE INVENTION

The invention provides a novel construction useful for a timepiece of the type having a shaped (i.e. non-circular) case and crystal in conjunction with a circular caseback to enable manufacture of the timepiece in acceptable sizes.

The invention also provides a novel timepiece construction of the type described which can be assembled by conventional manufacturing procedures wherein a subassembly of the watch movement and dial plate is inserted through a rear case opening, thereby minimizing the cost of the timepiece.

The invention additionally provides a novel timepiece construction of the type described which has the aesthetic features provided by a shaped case and crystal and yet which can be provided with the water resistance associated with a circular caseback construction.

Typically, the timepiece includes as one essential component a case having a non-circular recess in one side and a circular aperture in the other side with a cylindrical bore of one or more diameters connecting the recess and aperture together. The shaped recess and cylindrical bore form at their intersection an annular shoulder in the case at the bottom of the recess with the shoulder having a non-circular outer periphery and a circular inner periphery to define a circular opening in the bottom of the recess. Supported in the cylindrical bore, typically on the watch movement, and visible through the circular opening in the bottom of the recess is a circular dial plate which preferably has a circular pattern of time indicia thereon. A watch crystal of transparent plastic or the like and having a non-circular outer periphery is adapted to fit in the non-circular recess in the case to close off the recess.

Overlying the annular shoulder forming the bottom of the recess and preferably disposed between the crystal and annular shoulder is a decorative annular mask having a non-circular outer periphery corresponding to the shape of the recess and a circular inner periphery of such size as to provide a circular window for viewing the dial plate disposed in the cylindrical bore. Preferably the circular indicia pattern of the dial plate is aligned along the circular inner periphery of the decorative mask when viewed in this manner. The decorative annular mask functions to hide the annular shoulder of the recess from view and to provide a decorative border around the dial plate when viewed through the crystal. The decorative mask may take several forms including a preformed metal or plastic mask or a coating of metal, plastic, paint or the like on the bottom of the crystal or on the annular shoulder itself.

The timepiece of the invention is typically completed by releasably attaching a caseback, preferably of circular type, to the side of the case with the circular aperture to close off the latter. The timepiece can be made water resistant by incorporating a resilient O-ring between the circular caseback and case and by placing sealant such as epoxy between the shaped outer periphery of the crystal and the case.

As a result of the features enumerated above, the timepiece of the invention can be assembled in accordance with conventional procedures wherein a movement-dial plate subassembly is inserted through the rear case opening and yet still retains the aesthetic advantages associated with the shaped case and crystal.

DESCRIPTION OF THE DRAWINGS

A more detailed explanation of the invention can be had by reference to the following description of preferred embodiments in conjunction with the following drawings, in which.

DESCRIPTION OF PREFERRED EMBODIMENTS

As used herein, the term "shaped" as applied to a particular component means that the component has a non-circular cross-section or outline. Included within the term "shaped" but not limited thereto are components of elliptical, rectangular, oval and other shapes. Furthermore, although the invention is described herebelow with respect to a wristwatch, other forms of timepieces are included such as pendant watches, pocket watches and the like.

Figure 1:
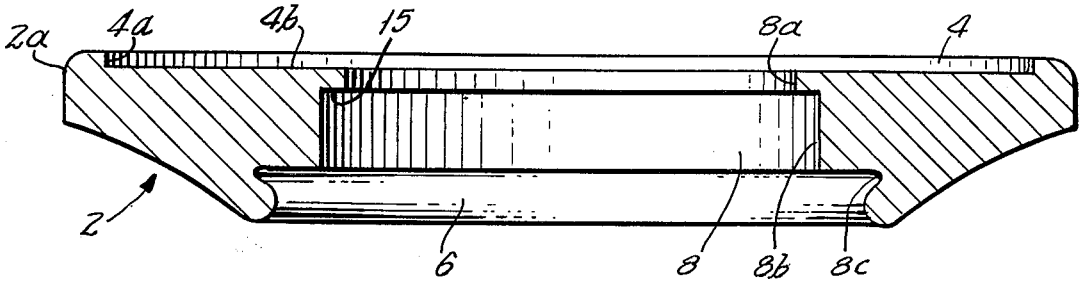
FIG. 1 is a cross-sectional view through a shaped watch case employed in the present invention.
Figure 3:
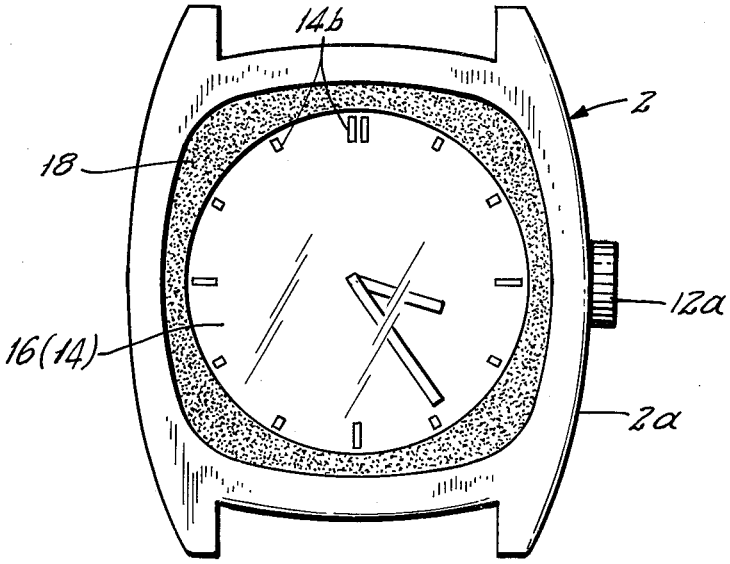
FIG. 3 is a full plan view of the assembled watch of FIG. 2.

Referring first to FIGS. 1 and 3, the case 2, which also may be referred to as a bezel, is provided with a shaped exterior periphery 2*a* such as a more or less elliptical configuration. The case 2 includes in its top side an elliptical recess 4 and in the bottom side a circular aperture 6 with a generally cylindrical bore 8 connecting the recess to the aperture. The cylindrical bore 8 typically comprises various cylindrical bore walls such as top wall 8*a* of a preselected smaller diameter which intersects the recess to form a central circular opening in the bottom thereof, intermediate wall 8*b* adapted to receive the movement-dial plate subassembly and bottom bore 8*c* of slightly larger diameter to form an annular groove. A watch case like that just described but having a circular rather than shaped exterior periphery may also be employed in the invention if desired.

As can be seen most clearly in FIG. 1, the shaped recess 4 is formed or bounded by upright peripheral wall 4*a* which of course is elliptical in outline and annular shoulder 4*b* which intersects the elliptical upright wall 4*a* at its outer periphery and the cylindrical bore wall 8*a* at its inner periphery. Thus, the annular shoulder 4*b* possesses an elliptical outer periphery and circular inner periphery. Preferably the shoulder is flat and horizontal although an arcuate shoulder may also be employed.

Figure 2:
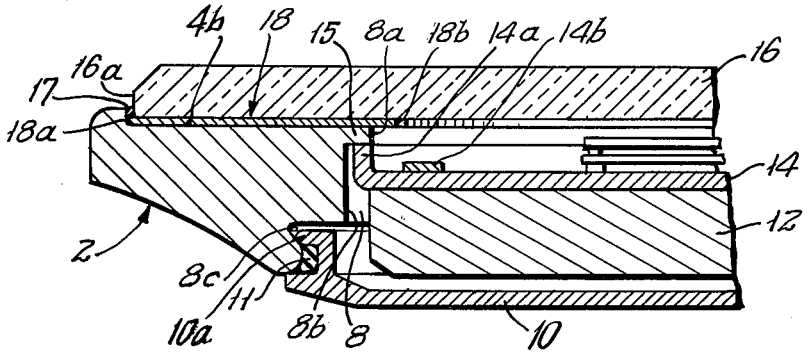
FIG. 2 is a partial cross-sectional view through the watch case after assembly with other components of the invention.

The watch case assembled with other components is shown in FIG. 2. A circular caseback 10 is shown with its circumferential lip 10*a* snap-fitted in the annular groove formed by wall 8*c* with an O-ring gasket 11 provided between the caseback and case in well known prior art fashion. In assembling the components of FIG. 2, the subassembly of watch movement 12 and dial plate 14 mounted atop the movement is inserted through circular aperture 6 and into cylindrical bore 8 before the caseback is attached. This procedure is commonly used in the mass assembly of watches. Thus, the watch of the invention can be readily incorporated into such assembly procedures and the cost of producing the watch can thereby be minimized. The dial plate 14 as well as the movement 12 are circular in cross-section. The dial plate includes an upright circumferential rim 14*a* which abuts against shoulder 15 of the case and cylindrical wall 8*b* for locating and positioning of the dial plate. In effect, this centers the dial plate 14 in the cylindrical bore defined by wall 8*b* and also with respect to the cylindrical bore defined by wall 8*a*. As shown in FIG. 3, dial plate 14 includes time indicia such as hour markers 14*b* in a circular pattern.

The movement 12 can be a well known conventional spring-driven movement with crown 12*a* or an electrically driven movement with or without quartz crystal or other oscillator means, and can be supported in the bore 8 in conventional well known fashion such that rim 14*a* of the dial plate is thrust against shoulder 15 of the case.

Received in the shaped recess 4 in the top side of the watch case is a watch glass or crystal 16. The crystal may be made of transparent plastic, mineral glass or other well known materials and has outer peripheral wall 16*a* shaped to mate with the elliptical upright wall 4*a* of the recess. For water resistance, epoxy 17 or other transparent adhesive/sealant is preferably disposed between the opposed, mating walls 4*a* and 16*a*.

As shown in FIG. 2, an annular decorative mask 18 is positioned between watch crystal 16 and annular recess shoulder 4*b*. The mask, like annular shoulder 4*b*, has an elliptical-shaped outer periphery 18*a* like that of the recess and a circular inner periphery 18*b* of such size to provide a circular window which surrounds the circular dial plate 14 when viewed through the crystal 16. The inner periphery of the decorative mask 18 preferably extends a preselected distance beyond the circular inner periphery of the recess shoulder 4*b* to overlap a portion of the dial plate 14 and provide an attractive border aligned adjacent the time indicia 14*b* on the dial plate. At the same time, the mask 18 also hides the annular recess shoulder 4*b* from view. The overall appearance of the watch with the decorative mask in place is shown in FIG. 3 with a minute hand and a hour hand.

It will be apparent the decorative mask 18 can be an independent component such as a preformed metallic sheet, opaque plastic film or the like or it may be provided in the form of an opaque coating deposited on the bottom of the watch crystal 16 or on shoulder 4*b* e.g. by metallizing, painting and other well known deposition techniques.

While the invention has been explained by a detailed description of certain specific embodiments, it is understood that various modifications and substitutions can be made in any of them within the scope of the appended claims which are intended also to include such modified embodiments.

I claim:

1. In a timepiece with a minute hand and an hour hand, the combination of:

(a) a case having a non-circular recess in one side intersecting with a cylindrical bore extending into said case, said bore including a first bore section adjacent to and intersecting said non-circular recess to form a first annular shoulder in said case at the bottom of the recess with said first shoulder having a non-circular outer periphery and a circular inner periphery defining a circular opening in the bottom of the recess and further including a second bore section of larger diameter below and intersecting said first bore section to form a second annular shoulder of circular outer and inner periphery recessed in said case below and hidden from view by said first shoulder;

(b) a transparent crystal with a non-circular outer periphery adapted to fit in said non-circular recess to close off said recess, said crystal having a bottom surface facing the bottom of said recess;

(c) a decorative annular mask attached to the bottom surface of said crystal and overlying the first annular shoulder to hide it from view, said mask having a non-circular outer periphery corresponding to that of said recess and having a circular inner periphery of such size to provide a circular window for viewing into the circular opening in the bottom of said recess and into said bore; and (d) a circular dial plate supported in the second bore section, said dial plate including a central, circular surface visible through the circular window in the mask for indicating time in cooperation with said hands and an up-turned, circumferential lip which abuts against the second annular shoulder in said case to position and space the central dial surface a preselected distance below the masked crystal.

2. The combination of claim 1 wherein the case is of non-circular exterior shape.

3. The combination of claim 1 wherein the dial plate includes a circular pattern of time indicia thereon which pattern appears to be aligned along the circular inner periphery of said decorative mask when viewed through said crystal.

4. The combination of claim 1 wherein the mask is a coating on the bottom of the crystal.

5. The combination of claim 1 wherein the circular inner periphery of the decorative mask extends beyond the annular shoulder and overlaps the dial plate.

6. A timepiece comprising:

(a) a case having a non-circular recess in one side and a circular aperture in the other side with a cylindrical bore connecting the recess and aperture together, said bore comprising a first bore section adjacent to and intersecting said non-circular recess to form a first annular shoulder in said case at the bottom of the recess with said first shoulder having a non-circular outer periphery and a circular inner periphery defining a circular opening in the bottom of the recess and further comprising a second bore section of larger diameter adjacent to said circular aperture and intersecting said circular aperture at one end and said first bore section at the other end to form a second annular shoulder of circular outer and inner periphery recessed in said case below and hidden from view by said first shoulder;

(b) a transparent crystal with a non-circular outer periphery adapted to fit in said non-circular recess so that the crystal closes off said recess, said crystal having a bottom surface facing the bottom of said recess;

(c) a decorative annular mask comprising a coating on the bottom surface of said crystal and overlying the first annular shoulder to hide it from view, said mask having a non-circular outer periphery corresponding to that of said recess and having a circular inner periphery of such size to provide a circular window for viewing into the circular opening in the bottom of said recess and into said bore;

(d) a movement positioned in the second bore section between said non-circular recess and circular aperture; and (e) a circular dial plate supported in the second bore section on the side of the movement facing the non-circular recess, said dial plate including a central, circular surface with time indicia thereon visible through the circular window in the mask and an upturned, circumferential lip which abuts against the second annular shoulder in said case to position and space the central dial surface a preselected distance below the masked crystal.

7. The timepiece of claim 6 wherein the case is of non-circular exterior shape.

8. The timepiece of claim 6 wherein the dial plate includes a circular pattern of time indicia thereon which are aligned so as to appear adjacent to the circular inner periphery of said decorative mask.

9. The timepiece of claim 6 wherein the decorative mask is a coating on the bottom of the crystal.

10. The timepiece of claim 6 further comprising a circular caseback releasably engaged to said other side of the case to close off the circular aperture.

11. A water-resistant timepiece comprising:

(a) a case of non-circular exterior shape, said case having a non-circular recess in one side and a circular aperture in the other side with a cylindrical bore connecting the recess and aperture together, said bore including a first bore section adjacent to and intersecting said non-circular recess to form a first annular shoulder in said case at the bottom of the recess with said first shoulder having a non-circular outer periphery and a circular inner periphery and defining a circular opening in the bottom of the recess and further including a second bore section of larger diameter adjacent to said circular aperture and intersecting said circular aperture at one end and said first bore section at the other end to form a second annular shoulder of circular outer and inner periphery recessed in said case below and hidden from view by said first shoulder;

(b) a substantially flat, transparent crystal having a non-circular outer periphery adapted to fit in said non-circular recess so that the crystal closes off said recess, said crystal having a bottom surface facing the bottom of said recess;

(c) epoxy sealant means disposed between the outer periphery of the crystal and the case to minimize entry of moisture into the case;

(d) a decorative annular mask comprising a coating on the bottom surface of said crystal overlying the first annular shoulder to hide it from view, said mask having a non-circular outer periphery corresponding to that of said recess and having a circular inner periphery of such size to provide a circular window for viewing into the circular opening in the bottom of said recess and into said bore;

(e) a movement positioned in the second bore section between said non-circular recess and circular aperture;

(f) a circular dial plate supported in the second bore section on the side of the movement facing the non-circular recess, said plate including a central, circular surface with time indicia thereon visible through the circular window in the mask and an upturned, circumferential lip which abuts against the second annular shoulder in said case to position and space the central dial surface a preselected distance below the masked crystal;

(g) a circular caseback releasably engaged to said other side of the case to close off the circular aperture; and (h) a resilient O-ring positioned between the caseback and case to minimize entry of moisture into the case.

* * * * *